US008517744B2

(12) United States Patent
Lin

(10) Patent No.: US 8,517,744 B2
(45) Date of Patent: Aug. 27, 2013

(54) CONNECTOR MECHANISM FOR CONNECTING A BOARD CARD

(75) Inventor: Li-Sheng Lin, New Taipei (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 16 days.

(21) Appl. No.: 13/452,952

(22) Filed: Apr. 23, 2012

(65) Prior Publication Data

US 2013/0023134 A1 Jan. 24, 2013

(30) Foreign Application Priority Data

Jul. 20, 2011 (TW) ..... 100125590 A

(51) Int. Cl.
*H01R 12/00* (2006.01)

(52) U.S. Cl.
USPC ..... 439/62; 439/533

(58) Field of Classification Search
USPC ..... 439/59–62, 326–328, 533–534, 630
See application file for complete search history.

(56) References Cited

U.S. PATENT DOCUMENTS

| | | | | |
|---|---|---|---|---|
| 4,498,717 | A * | 2/1985 | Reimer | 439/61 |
| 6,955,554 | B2 * | 10/2005 | Korsunsky et al. | 439/328 |
| 7,114,974 | B2 * | 10/2006 | Korsunsky et al. | 439/325 |
| 7,300,299 | B2 * | 11/2007 | Wang et al. | 439/326 |
| 7,628,655 | B1 * | 12/2009 | Chen | 439/660 |

* cited by examiner

*Primary Examiner* — Khiem Nguyen
(74) *Attorney, Agent, or Firm* — Winston Hsu; Scott Margo

(57) ABSTRACT

A connector mechanism includes a circuit board whereon an electrical contact and a hole are formed, a socket where an end of a board card is inserted, a fixing base disposed on a side of the socket, a positioning component disposed on the fixing base and inserted into the hole at an end so as to fix the fixing base on the circuit board, and a connecting component detachably installed on the fixing base. The connecting component includes an engaging portion for engaging with the fixing base and contacting with the electrical contact, and a connecting terminal installed on an end of the engaging portion for contacting with a terminal on the other end of the board card as the engaging portion engages with the fixing base and the end of the board card is inserted into the socket.

6 Claims, 4 Drawing Sheets

CONNECTOR MECHANISM FOR CONNECTING A BOARD CARD

BACKGROUND OF THE INVENTION

1. Field of the Invention

The present invention relates to a connector mechanism for connecting a board card, and more specifically, to a connector mechanism with a detachable connecting component.

2. Description of the Prior Art

Portable computers, such as notebook computers and tablet computers, are now commonly used for personal computing. Because they are small and light, notebook computers are suitable to be taken out of the home or office for document processing. Because wireless transmission techniques are maturing, hard-wired connections with electric network lines are no longer needed to transmit electrical signals, and signals may be received or transmitted from anywhere in a wireless manner by an antenna. In general, a wireless network card can transmit wireless signals conforming to corresponding specification. Cables are often utilized to connect the antenna module and the wireless network card in conventional mechanical design of a connector of the wireless network card. However, it often decays signal intensity and increases manufacture cost, assembly labor hour and assembly complexity. Furthermore, the cables might be broken as passing through a hinge connection of a display device and a host. In addition, the wireless network card is often screwed or hooked for assembly. The hook structure might be broken due to frequent assembly, resulting in reduction of product reliability.

SUMMARY OF THE INVENTION

The present invention provides a connector mechanism with a detachable connecting component, to solve the problems mentioned above.

According to the claimed invention, a connector mechanism includes a circuit board whereon at least one electrical contact and at least one hole are formed, and a socket installed on the circuit board. An end of a board card is inserted into the socket. The connector mechanism further includes a fixing base installed on the circuit board and disposed on a side of the socket, at least one positioning component disposed on the fixing base and inserted into the at least one hole at an end so as to fix the fixing base on the circuit board, and at least one connecting component detachably installed on the fixing base. The at least one connecting component includes an engaging portion for engaging with the fixing base and contacting with the at least one electrical contact, and a connecting terminal installed on an end of the engaging portion for contacting with a terminal on the other end of the board card as the engaging portion engages with the fixing base and the end of the board card is inserted into the socket.

According to the claimed invention, the at least one positioning component is a positioning post, a protrusion structure is formed at the other end of the at least one positioning component, and the protrusion structure prevents the board card from separating from the positioning component as the other end of the at least one positioning component is inserted into an opening of the board card.

According to the claimed invention, a slot is formed on the protrusion structure.

According to the claimed invention, the connector mechanism further includes a fastening component for fastening the fixing base on the circuit board.

According to the claimed invention, at least one antenna printed circuit is disposed on the circuit board and coupled to the at least one electrical contact.

According to the claimed invention, the engaging portion is a U-shaped conductive clip for clipping the fixing base.

In contrast to the prior art, the connection mechanism of the present invention applies for mechanical design of the antenna directly disposed on the circuit board, and it can reduce signal decay, save manufacture cost, reduce assembly labor hour and assembly complexity, and prevent an issue of broken cables. Furthermore, the connection mechanism of the present invention utilizes the positioning post to fix the board card on the fixing base so as to prevent the disadvantage of the conventional hook structure being broken easily due to frequent assembly. Furthermore, the connector mechanism of the present invention can adjust relative position of the detachable connecting components thereof for suiting with the corresponding board card. Hence, it can solve the problem that the conventional connector mechanism and the circuit board are needed to be redesigned and remolded as applying for the wireless network cards conforming to different specification, and it enhances utilization flexibility of the connector mechanism of the present invention.

These and other objectives of the present invention will no doubt become obvious to those of ordinary skill in the art after reading the following detailed description of the embodiment that is illustrated in the various figures and drawings.

DETAILED DESCRIPTION

Figure 1:
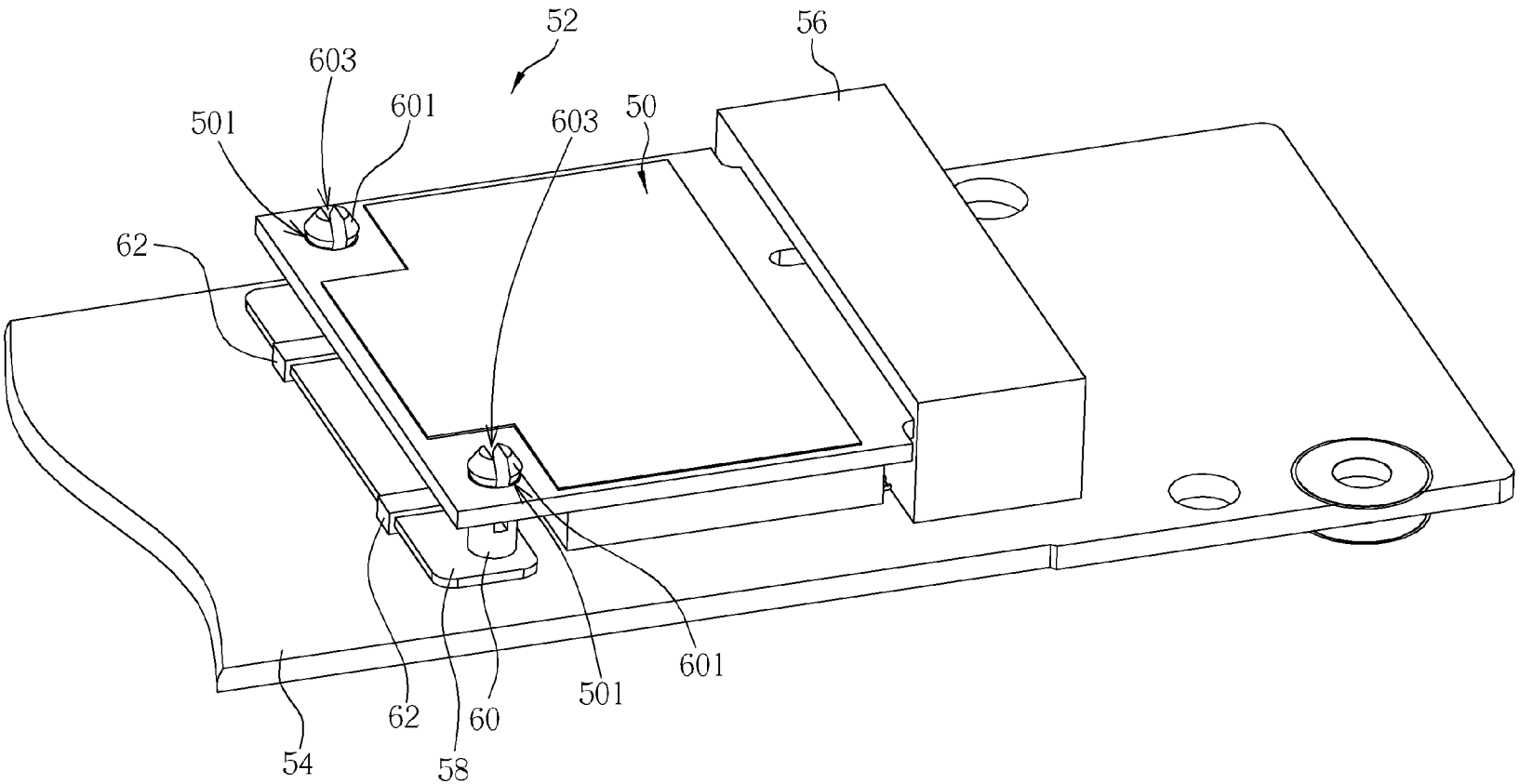
FIG. 1 is a schematic drawing of a connector mechanism for connecting a board card according to an embodiment of the present invention.
Figure 2:
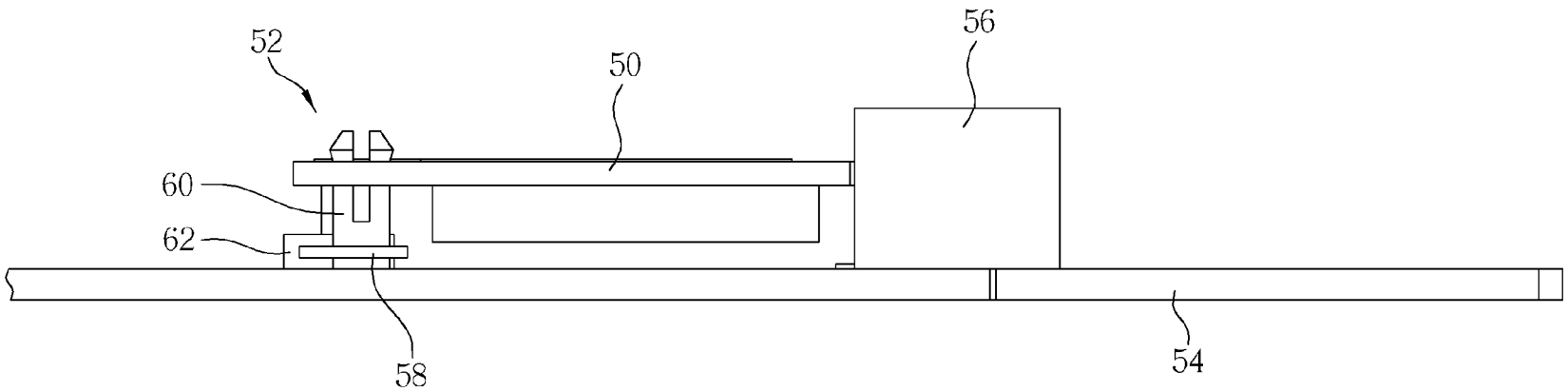
FIG. 2 is a lateral view of the board card and the connector mechanism according to the embodiment of the present invention.
Figure 3:
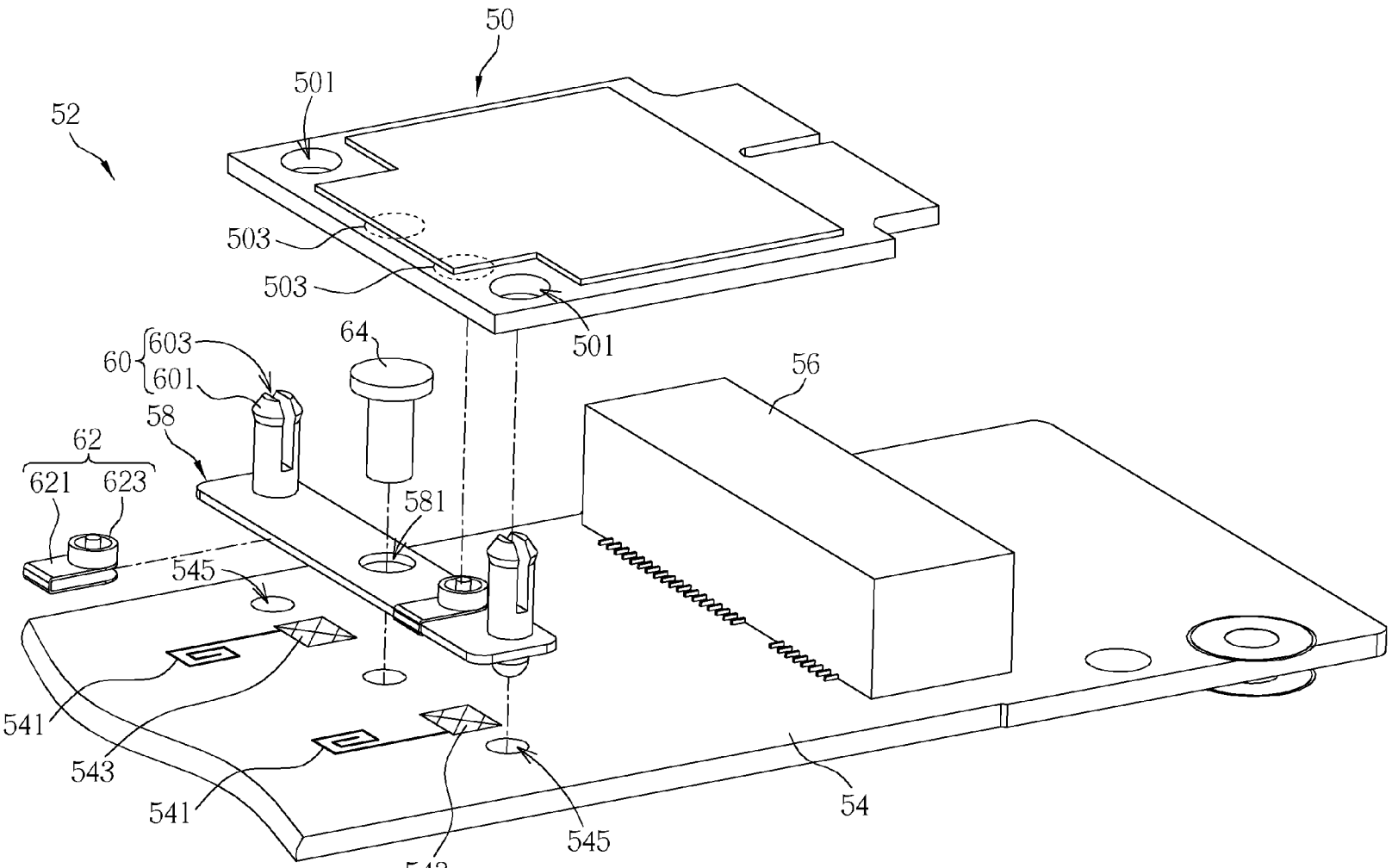
FIG. 3 is an exploded drawing of the connector mechanism according to the embodiment of the present invention.

Please refer to FIG. 1 to FIG. 3. FIG. 1 is a schematic drawing of a connector mechanism 52 for connecting a board card 50 according to an embodiment of the present invention. FIG. 2 is a lateral view of the board card 50 and the connector mechanism 52 according to the embodiment of the present invention. FIG. 3 is an exploded drawing of the connector mechanism 52 according to the embodiment of the present invention. The board card 50 can be a wireless network card, such as a wireless local area network (WLAN) card or a wireless wide area network (WWAN) card and so on, and can be installed inside a notebook computer. The connector mechanism 52 includes a circuit board 54, which can be a printed circuit board. At least one antenna printed circuit 541 can be disposed on the circuit board 54 for receiving and transmitting wireless signals. At least one electrical contact 543 is formed on the circuit board 54 and coupled to the antenna printed circuit 541. At least one hole 545 is also formed on the circuit board 54.

Figure 4:
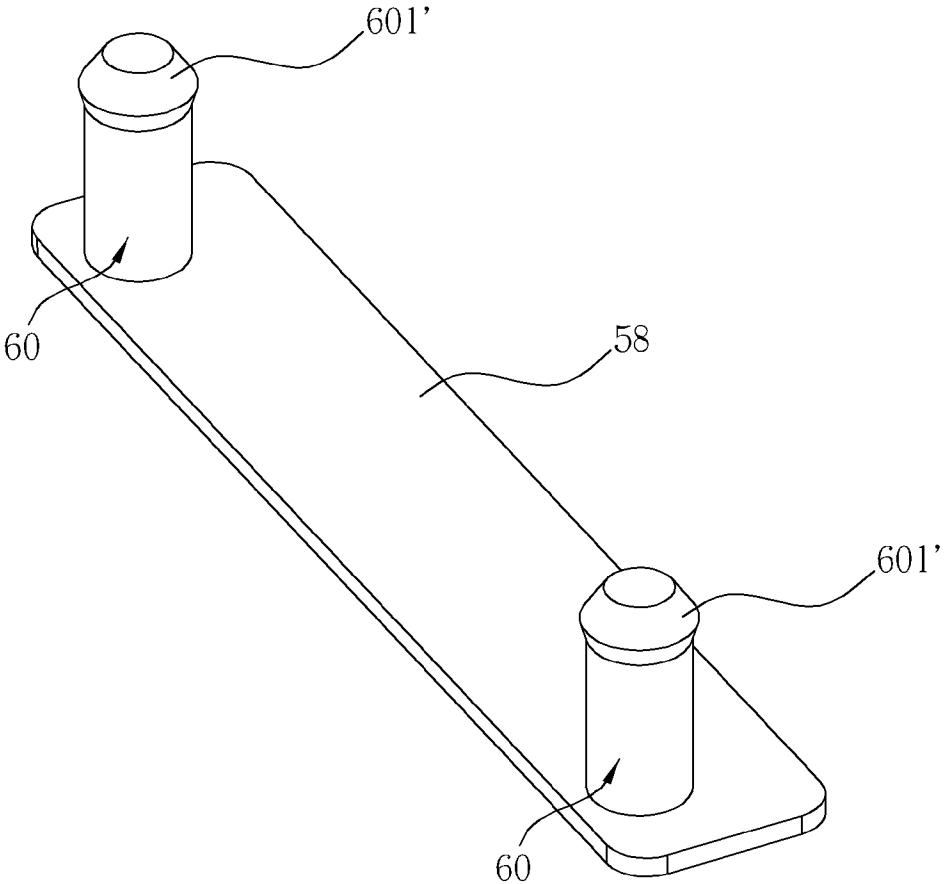
FIG. 4 is a diagram of a protrusion structure according to another embodiment of the present invention.

The connector mechanism 52 further includes a socket 56 installed on the circuit board 54. An end of the board card 50 is inserted into the socket 56 for transmitting signals with the circuit board 54. The connector mechanism 52 further includes a fixing base 58 installed on the circuit board 54 and disposed on a side of the socket 56. The fixing base 58 can be a plate structure, and an orifice 581 is formed on the fixing base 58. The connector mechanism 52 further includes at least one positioning component 60 disposed on the fixing base 58 and inserted into the hole 545 on the circuit board 54 at an end, so as to fix the fixing base 58 on the circuit board 54. The positioning component 60 can be a positioning post, and a protrusion structure 601 is formed at the other end of the positioning component 60. The protrusion structure 601 can prevent the board card 50 from separating from the positioning component 60 as the other end of the positioning component 60 is inserted into an opening 501 of the board card 50, so as to fix the board card 50 on the circuit board 54. A slot 603 is formed on the protrusion structure 601, so that the protrusion structure 601 can inwardly deform easily as the protrusion structure 601 is passing through the opening 501 of the board card 50, to achieve easy assembly for the board card 50. Please refer to FIG. 4. FIG. 4 is a diagram of a protrusion structure 601' according to another embodiment of the present invention. The protrusion structure 601' can be made of elastic material, and there is no slot formed on the protrusion structure 601' instead. As the protrusion structure 601' is passing through the opening 501 of the board card 50, the protrusion structure 601' can be elastically deformed to overcome interference therebetween. The structural design capable of passing the protrusion structure through the opening 501 of the board card 50 and preventing the board card 50 from separating from the positioning component 60 is within the scope of the present invention. Furthermore, the connector mechanism 52 includes the two positioning components 60 disposed on two sides of the fixing base 58. The disposal and amount of the positioning component 60 are not limited to those of the embodiment, and it depends on actual design demand.

The connector mechanism 52 further includes at least one connecting component 62 detachably installed on the fixing base 58. The connector mechanism 52 includes the two connecting components 62 disposed on the two sides of the fixing base 58. The disposal and amount of the connecting component 62 are not limited to those of the embodiment, and it depends on actual design demand. Each connecting component 62 includes an engaging portion 621 for engaging with the fixing base 58 and contacting with the corresponding electrical contact 543 on the circuit board 54. For example, the engaging portion 621 can be a U-shaped conductive clip for clipping the fixing base 58. When the engaging portion 621 engages with the fixing base 58, an end of the engaging portion 621, which faces the circuit board 54, contacts with the corresponding electrical contact 543 on the circuit board 54. Each connecting component 62 further includes a connecting terminal 623 installed on the other end of the engaging portion 621, such as being installed on an end of the engaging portion 621, which can be a U-shaped conductive clip, away from the circuit board 54. The connecting terminals 623 respectively contact with terminals 503 on the other end of the board card 50 as the engaging portion 621 engages with the fixing base 58 and the end of the board card 50 is inserted into the socket 56, so as to electrically connect to the board card 50. The connector mechanism 52 further includes a fastening component 64 passing through the orifice 581 on the fixing base 58 for fastening the fixing base 58 on the circuit board 54, so as to fix the fixing base 58. The fastening component 64 can be a screw.

As for assembly of the connector mechanism 52, the two connecting components 62 can be engaged with the fixing base 58 first, and the engaging positions of the two connecting components 62 respectively correspond to the two electrical contacts 543 on the circuit board 54. Then, the end of each positioning components 60 is inserted into the corresponding hole 545 on the circuit board 54, and the fastening component fastens the fixing base 58 on the circuit board 54, so as to fix the fixing base 58 on the circuit board 54. At this time, the engaging portion 621 of each connecting component 62 contacts the corresponding electrical contact 543 on the circuit board 54. For connecting the board card 50 to the circuit board 54, the end of the board card 50 can be inserted into the socket 56 on the circuit board 54 obliquely, so as to transmit signals with the circuit board 54. Then, the other end of the board card 50 can be pressed down for positioning the board card 50 parallel to the circuit board 54 substantially. At this time, the protrusion structures 601 are inserted into the openings 501 on the board card 50 for preventing the board card 50 from separating from the positioning components 60, so as to fix the board card 50 on the circuit board 54. And the connecting terminals 623 contact with the terminals 503 on the board card 50, for electrically connecting to the board card 50, so that the board card 50 and the antenna printed circuit 541 on the circuit board 54 can transmit signals with each other. It should be noticed that even the connector mechanism 52 is for connecting the board cards conforming to different specification, that is, there are different distances between the terminals 503 on the different board cards 50, the relative position of the detachable connecting components 62 can be adjusted for respectively contacting with the corresponding terminals 503 on the board card 50, without the influence of assembly tolerance. It can solve the problem that the conventional connector mechanism and the circuit board are needed to be redesigned and remolded as applying for the wireless network cards conforming to different specification, and it enhances utilization flexibility of the connector mechanism 52 of the present invention.

In contrast to the prior art, the connection mechanism of the present invention applies for mechanical design of the antenna directly disposed on the circuit board, and it can reduce signal decay, save manufacture cost, reduce assembly labor hour and assembly complexity, and prevent an issue of broken cables. Furthermore, the connection mechanism of the present invention utilizes the positioning post to fix the board card on the fixing base so as to prevent the disadvantage of the conventional hook structure being broken easily due to frequent assembly. Furthermore, the connector mechanism of the present invention can adjust relative position of the detachable connecting components thereof for suiting with the corresponding board card. Hence, it can solve the problem that the conventional connector mechanism and the circuit board are needed to be redesigned and remolded as applying for the wireless network cards conforming to different specification, and it enhances utilization flexibility of the connector mechanism of the present invention.

Those skilled in the art will readily observe that numerous modifications and alterations of the device and method may be made while retaining the teachings of the invention.

What is claimed is:

1. A connector mechanism for connecting a board card, comprising:

a circuit board whereon at least one electrical contact and at least one hole are formed;

a socket installed on the circuit board, an end of the board card being inserted into the socket;

a fixing base installed on the circuit board and disposed on a side of the socket;

at least one positioning component disposed on the fixing base and inserted into the at least one hole at an end, so as to fix the fixing base on the circuit board; and at least one connecting component detachably installed on the fixing base, the at least one connecting component comprising:

an engaging portion for engaging with the fixing base and contacting with the at least one electrical contact; and a connecting terminal installed on an end of the engaging portion for contacting with a terminal on the other end of the board card as the engaging portion engages with the fixing base and the end of the board card is inserted into the socket.

2. The connector mechanism of claim 1, wherein the at least one positioning component is a positioning post, a protrusion structure is formed at the other end of the at least one positioning component, and the protrusion structure prevents the board card from separating from the positioning component as the other end of the at least one positioning component is inserted into an opening of the board card.

3. The connector mechanism of claim 2, wherein a slot is formed on the protrusion structure.

4. The connector mechanism of claim 1, further comprising a fastening component for fastening the fixing base on the circuit board.

5. The connector mechanism of claim 1, wherein at least one antenna printed circuit is disposed on the circuit board and coupled to the at least one electrical contact.

6. The connector mechanism of claim 1, wherein the engaging portion is a U-shaped conductive clip for clipping the fixing base.

* * * * *